US010047426B2

(12) United States Patent
Kim et al.

(10) Patent No.: US 10,047,426 B2
(45) Date of Patent: Aug. 14, 2018

(54) WROUGHT MAGNESIUM ALLOY CAPABLE OF BEING HEAT TREATED AT HIGH TEMPERATURE

(71) Applicant: KOREA INSTITUTE OF MACHINERY & MATERIALS, Daejeon (KR)

(72) Inventors: Young Min Kim, Changwon-si (KR); Ha Sik Kim, Changwon-si (KR); Bong Sun You, Changwon-si (KR); Chang Dong Yim, Changwon-si (KR); Sung Hyuk Park, Changwon-si (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 318 days.

(21) Appl. No.: 14/126,099

(22) PCT Filed: Feb. 1, 2013

(86) PCT No.: PCT/KR2013/000826
§ 371 (c)(1),
(2) Date: Dec. 13, 2013

(87) PCT Pub. No.: WO2013/115593
PCT Pub. Date: Aug. 8, 2013

(65) Prior Publication Data

US 2014/0116580 A1 May 1, 2014

(30) Foreign Application Priority Data

Feb. 3, 2012 (KR) ..... 10-2012-0011031

(51) Int. Cl.
*C22C 23/00* (2006.01)
*C22C 23/02* (2006.01)
*C22F 1/06* (2006.01)

(52) U.S. Cl.
CPC ..... *C22F 1/06* (2013.01); *C22C 23/00* (2013.01); *C22C 23/02* (2013.01)

(58) Field of Classification Search
CPC ..... C22C 23/00; C22C 23/02
USPC ..... 148/420, 557; 420/402, 405–413
See application file for complete search history.

(56) References Cited

U.S. PATENT DOCUMENTS

2008/0317621 A1* 12/2008 Aoki ..... C22C 1/02 420/402
2012/0070248 A1* 3/2012 Kuwabara ..... C22C 23/02 411/378

FOREIGN PATENT DOCUMENTS

| | | |
|---|---|---|
| JP | 2006-070303 | 3/2006 |
| JP | 2011-006778 | 1/2011 |
| KR | 2003-0044997 | 6/2003 |
| KR | 10-2011-0078446 | 7/2011 |

* cited by examiner

*Primary Examiner* — Brian Walck
(74) *Attorney, Agent, or Firm* — Lex IP Meister, PLLC

(57) ABSTRACT

Disclosed are a magnesium (Mg) alloy and a manufacturing method thereof. The Mg alloy has a composition including, by weight, 4% to 10% of Sn, 0.05% to 1.0% of Ca, 0.1% to 2% of at least one element selected from the group including Y and Er, the balance of Mg, and the other unavoidable impurities. The Mg alloy includes an Mg2Sn phase having excellent thermal stability, and is capable of being heat treated at a temperature of 480° C. or more.

7 Claims, 6 Drawing Sheets

WROUGHT MAGNESIUM ALLOY CAPABLE OF BEING HEAT TREATED AT HIGH TEMPERATURE

TECHNICAL FIELD

The present invention relates to a wrought magnesium alloy containing tin capable of being heat treated at high temperature and, more particularly, to a wrought magnesium alloy which can be heat treated at high temperature even in the air or under a general inert atmosphere, and which has outstanding ignition resistance and thus can suppress the spontaneous ignition of chips, and which has outstanding strength and ductility.

BACKGROUND ART

Magnesium alloys, which have a high specific strength, are the lightest of alloys, are applicable in a variety of casting and wrought processes, and have a wide range of application, and are thereby used in almost all fields in which light weight is required, such as parts for vehicles and electromagnetic parts. However, magnesium (Mg) is a metallic element that has a low electrochemical potential and is very active. Mg still has limitations in terms of the stability and reliability of the material, since it undergoes a strong reaction when it comes into contact with oxygen or water, and a commercial Mg alloy mostly has an ignition temperature of below 550° C., which sometimes causes fires. Therefore, the application fields in which Mg can be applied are still limited compared to its potential applicability. In particular, it cannot be used in applications in which safety is important.

Further, research carried out into a magnesium alloy to date has only concentrated on a casting alloy which is adaptable to an engine, gear parts, or the like of a vehicle based on excellent castability of Mg, but, at present, there is a shortfall in research on a wrought magnesium alloy in the form of extrusion or plate which, due to its excellent mechanical properties, can be more diversely applied to the fields in which weight reduction is required.

As shown in FIG. 1, a precipitation-hardened Mg—Sn alloy has a high melting point in an eutectic structure and excellent thermal stability, and thus excellent hot-workability, compared to a commercial Mg—Al alloy. As shown in FIG. 2, it can be seen that the Mg—Al alloy shows a tendency to considerably decrease in extrusion rate when Al content increases for high strength, whereas the Mg—Sn alloy has a very high extrusion rate of 20 m/min or more even when 10% by weight of Sn is added. Further, as disclosed in Korean Patent No. 10-0994812, an Mg—Sn alloy is added with zinc (Zn) and aluminum (Al), and a resulting mixture is then extruded and heat-treated to enhance structure refining and precipitation hardening and solid-solution hardening effects, thereby forming an extruded Mg alloy having high strength and ductility. Particularly, in manufacture of the above alloy, it is essential that a billet cast prior to extrusion be treated with a homogenization annealing process at 480 to 520° C. for 0.5 to 24 hours.

However, since the Mg—Sn alloy has an ignition temperature of 400° C. or less and thus poor ignition resistance, it is required that a vacuum or shielding gas such as $SF_6$ be used in performing the homogenization annealing process. However, there are problems in meeting the conditions in that addition of a vacuum apparatus to create a vacuum increases manufacturing cost, or $SF_6$ is expensive and is classified as a greenhouse gas, the global-warming potential (GWP) of which is 23,900 times that of $CO_2$, so that the use thereof is expected to be regulated in the future time. A further problem is that, in the case of performing heat treatment using a conventional heat-treating furnace that is commercially available, even when shielding gases are supplied to the inner wall of the furnace, a fire risk is still high there because the shielding effect with respect to the outside is not perfect.

Therefore, in order to basically suppress the fire risk during heat treatment and to maximize mechanical properties of an Mg—Sn alloy, it is necessary to develop an alloy in which ignition resistance thereof is improved without degradation of entire mechanical properties, thereby being capable of being heat treated at a temperature of 480° C. or more in the air or under a general inert atmosphere.

DISCLOSURE

Technical Problem

Therefore, an object of the present invention is to provide a magnesium alloy that is intended to solve the foregoing problems of the related art.

Specifically, an object of the present invention is to provide a magnesium alloy containing Sn that has an ignition temperature of 500° C. or more and is thus capable of being heat treated at high temperature.

In addition, an object of the present invention is to provide a magnesium alloy containing Sn that enables an environment-friendly manufacturing process, which uses a minimum amount of Ca and Y and does not use a shielding gas such as $SF_6$, which is an environmental pollutant.

Technical Solution

In order to realize the foregoing objects, according to an embodiment of the present invention, provided is a wrought magnesium (Mg) alloy that has a composition including: by weight, 4% to 10% of Sn; 0.05% to 1.0% of Ca; 0.1% to 2% of at least one element selected from the group including Y and Er; the balance of Mg; and the other unavoidable impurities, wherein the Mg alloy includes an $Mg_2Sn$ phase having excellent thermal stability, and is capable of being heat treated at a temperature of 480° C. or more.

In addition, it is preferred that the content of Sn range, by weight, from 4.5% to 8.5%.

Further, it is preferred that the content of Ca range, by weight, from 0.05% to 0.6%.

In addition, it is preferred that the content of the at least one element selected from Y and Er range, by weight, from 0.1% to 1%.

Further, it is preferred that the composition of the Mg alloy further include, by weight, 0.5% to 6.5% of Al.

In addition, it is preferred that the composition of the Mg alloy further include, by weight, 0.1% to 3% of Zn.

Further, it is preferred that the composition of the Mg alloy further include, by weight, greater than 0% but not greater than 0.5% of Mn.

In addition, the Mg alloy may have an ignition temperature of 480° C. or more, preferably 500° C. or more.

According to a preferred embodiment of the present invention, provided is a method of manufacturing a wrought magnesium alloy. The method includes the following steps of:

forming a molten magnesium alloy, which contains: Ca; Sn; Ca; and at least one element selected from Y and Er;

producing a magnesium alloy from the molten magnesium alloy using a casting method;

performing a homogenization annealing process on the magnesium alloy at a temperature of 480° C. or more; and working the homogenized magnesium alloy using at least one method selected from extrusion, rolling, forging, and drawing. The magnesium alloy produced as described above has a composition that includes: by weight, 4% to 10% of Sn; 0.05% to 1.0% of Ca; 0.1% to 2% of at least one element selected from the group including Y and Er; the balance of Mg; and the other unavoidable impurities, wherein the Mg alloy includes an $Mg_2Sn$ phase having excellent thermal stability, and is capable of being heat treated at a temperature of 480° C. or more.

According to another embodiment of the present invention, provided is a method of manufacturing a wrought magnesium alloy. The method includes the following steps of:

forming a molten magnesium alloy, which contains at least Mg and Sn;

producing a magnesium master alloy ingot, which contains: Sn; Ca; and at least one element selected from Y and Er;

inputting the magnesium master alloy ingot into the molten magnesium alloy and producing a magnesium alloy using a casting method;

performing a homogenization annealing process on the magnesium alloy at a temperature of 480° C. or more; and working the homogenized magnesium alloy using at least one method selected from extrusion, rolling, forging, and drawing. The magnesium alloy produced as described above has a composition that includes: by weight, 4% to 10% of Sn; 0.05% to 1.0% of Ca; 0.1% to 2% of at least one element selected from the group including Y and Er; the balance of Mg; and the other unavoidable impurities, wherein the Mg alloy includes an $Mg_2Sn$ phase having excellent thermal stability, and is capable of being heat treated at a temperature of 480° C. or more.

In addition, it is preferred that the content of Sn range, by weight, from 4.5% to 8.5%.

Further, it is preferred that the composition of the Mg alloy further include, by weight, 0.5% to 6.5% of Al.

In addition, it is preferred that the composition of the Mg alloy further include, by weight, 0.1% to 3% of Zn.

Further, it is preferred that the composition of the Mg alloy further include, by weight, greater than 0% but not greater than 0.5% of Mn.

The reasons why the content of respective components in the magnesium alloy of the present invention is limited are as follows.

Tin (Sn)

Although Sn forms an $Mg_2Sn$ phase in combination with Mg as shown in FIG. 3, a solubility limit thereof in a Mg matrix is approximately 10% by weight, so that, when Sn is added by 10% or more by weight, a coarse $Mg_2Sn$ phase is created in an excessively high fraction during solidification, thereby causing cracks during hot working and thus degrading workability, since a high fraction of coarse $Mg_2Sn$ phase cannot be sufficiently reduced even using heat treatment. Further, the coarse $Mg_2Sn$ phase still remains in a considerable amount in a final product, resulting in reduction of elongation. On the contrary, when Sn is added by less than 4% by weight, it cannot be expected that a precipitation hardening effect owing to a $Mg_2Sn$ phase occurs, resulting in reduction of strength. Therefore, it is preferred that the content of Sn range, by weight, from 4% to 10%, more preferably from 4.5% to 8.5%.

Calcium (Ca)

When added to an Mg alloy, Ca forms a thin and dense oxide layer of CaO on the surface of a molten alloy to reduce the oxidation of the molten alloy, thereby improving the ignition resistance of the Mg alloy. However, when the content of Ca is less than 0.05% by weight, the effect to improve ignition resistance is not significant. On the other hand, when the content of Ca is greater than 1.0% by weight, the castability of the molten alloy decreases, hot cracking occurs, die sticking increases, and elongation significantly decreases, which are problematic. Particularly, in the case of an Sn-containing Mg alloy, when Ca is added by 1% or more by weight, a coarse Ca2Sn phase is created in a molten alloy so as to degrade mechanical properties of the Mg alloy, particularly a great reduction in elongation. Therefore, in the Mg alloy of the present invention, Ca is added in an amount by weight ranging preferably from 0.05% to 1.0%, more preferably from 0.1% to 0.6%.

Yttrium (Y), Erbium (Er)

Y and Er are generally used as an element that increases high-temperature creep resistance due to precipitation hardening, since it has a high solubility limit with respect to Mg. further, when added to a molten Mg alloy, Y or Er forms an oxide layer of $Y_2O_3$ or $Er_2O_3$ on the surface of the molten alloy to considerably increase the ignition temperature of the alloy. Particularly, when a small amount of Y or Er is added to the Mg alloy together with Ca, a combined layer of MgO, CaO, and $Y_2O_3$ ($Er_2O_3$) is formed so as to further increase the ignition temperature. On the other hand, when Y or Er is added in an amount by weight of less than 0.05% to the Mg alloy, an increase in the ignition temperature is not significant. Further, when Y or Er is excessively added, the price of the Mg alloy rises. Therefore, in the Mg alloy of the present invention, at least one selected from Y and Er is added in an amount by weight ranging preferably from 0.05% to 2.0%, more preferably from 0.1% to 1.0%.

Aluminum (Al)

It is known that, when added to an Sn-containing Mg alloy, Al enhances a precipitation hardening effect of $Mg_2Sn$ phase and also increases the strength of the alloy due to a solid-solution hardening effect. Further, when the content of Al increases in the Mg alloy, generally, the Al improves fluidity and thus castability as well as ignition resistance. When the content of Al is less than 0.5% by weight, such effects do not occur, and when the content of Al is greater than 6.5% by weight, hot workability and tensile properties are degraded due to a coarse $Mg_{17}Al_{12}$ eutectic phase that has poor thermal stability. Therefore, it is preferred that Al be contained in the range, by weight, from 0.5% to 6.5%.

Zinc (Zn)

It is known that, when added to an Sn-containing Mg alloy, Zn refines an $Mg_2Sn$ phase that is a thermally stable phase, thereby enhancing a precipitation hardening effect as well as the strength of the alloy due to solid-solution hardening. When Zn is added in an amount of less than 0.1% by weight, such effects cannot be expected. Further, when the content of Zn exceeds 3% by weight, the Mg alloy cannot be treated with a homogenization annealing process at a high temperature of 480° C. or more, so that a fraction of coarse $Mg_2Sn$ phase in a structure increases so as to weaken elongation of the alloy, since the temperature at the solidus line of the alloy is lowered to 480° C. or less. Therefore, it is preferred that Zn be added in an amount by weight ranging from 0.1% to 3%.

Other Unavoidable Impurities

The Mg alloy of the present invention may contain impurities that are unavoidably mixed from raw materials thereof or during the process of manufacture. Among the impurities that can be contained in the Mg alloy of the invention, iron (Fe), silicon (Si) and nickel (Ni) are components that particularly worsen the corrosion resistance of the Mg alloy. Therefore, it is preferred that the content of Fe be maintained at 0.004% or less by weight, the content of Si be maintained at 0.04% or less by weight, and the content of Ni be maintained at 0.001% or less by weight.

Advantageous Effects

The Mg alloy according to the invention considerably improves ignition resistance without degradation of mechanical properties by combined addition of Ca and Y and/or Er based on an Mg—Sn alloy, thereby being heat treated at high temperature and hot-worked in the air or a general inert atmosphere (Ar, $N_2$) in a safe manner compared to a conventional Mg—Sn alloy, and suppressing the spontaneous ignition of chips that are accumulated during the process of machining.

In addition, the Mg alloy according to the invention is adapted to reduce costs, protect the health of workers, and prevent environmental pollution since it does not use a harmful gas such as $SF_6$.

Moreover, the Mg alloy according to the invention can be variously used as a processing material, since it has excellent ignition resistance as well as excellent hot workability, and in particular, the Mg alloy can be manufactured as an extruded material, a sheet material, a forged material, and the like, which can be practically applied to next-generation vehicles, high-speed rail systems, urban railway systems, and the like, in which high-strength, high-elongation and safety characteristics are required.

BEST MODE

Figure 1:
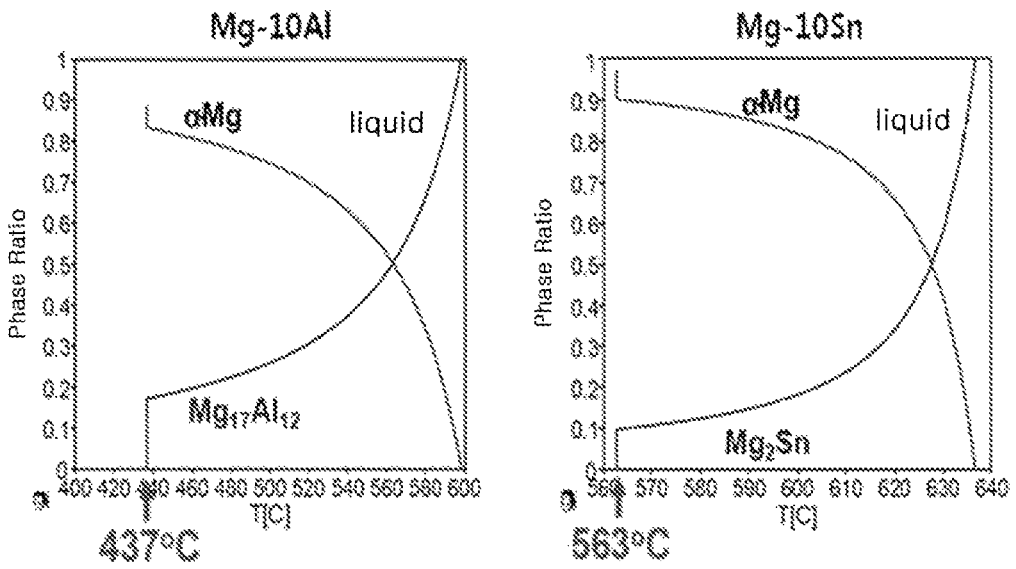
FIG. 1 shows graphs which illustrate phase-formation behaviors of Mg-10 wt % Al alloy and Mg-10 wt % Sn alloy, which are estimated by computational thermodynamics.
Figure 2:
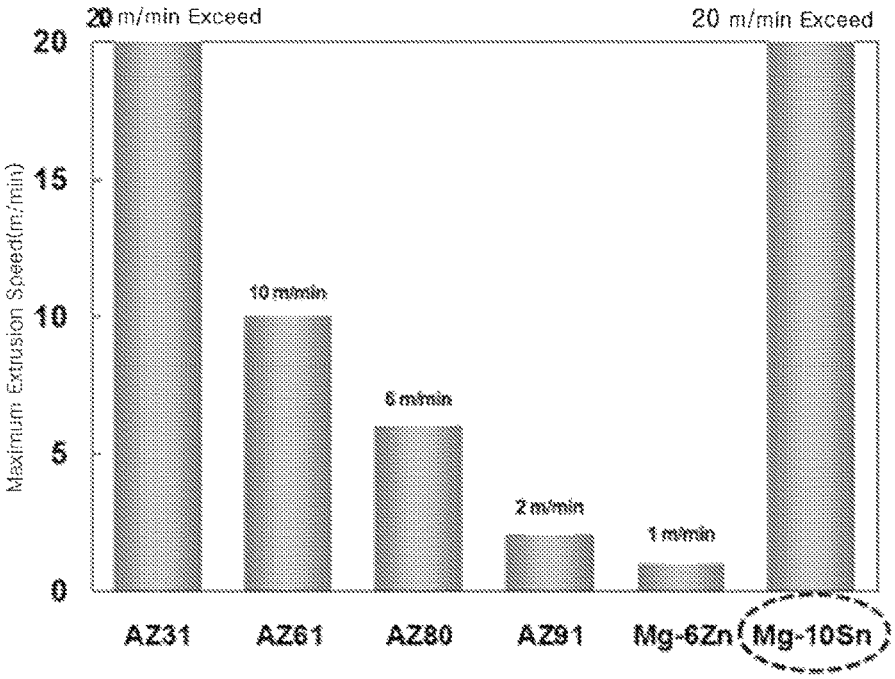
FIG. 2 is a graph showing a maximum extrusion speed according to kinds of Mg alloys.
Figure 3:
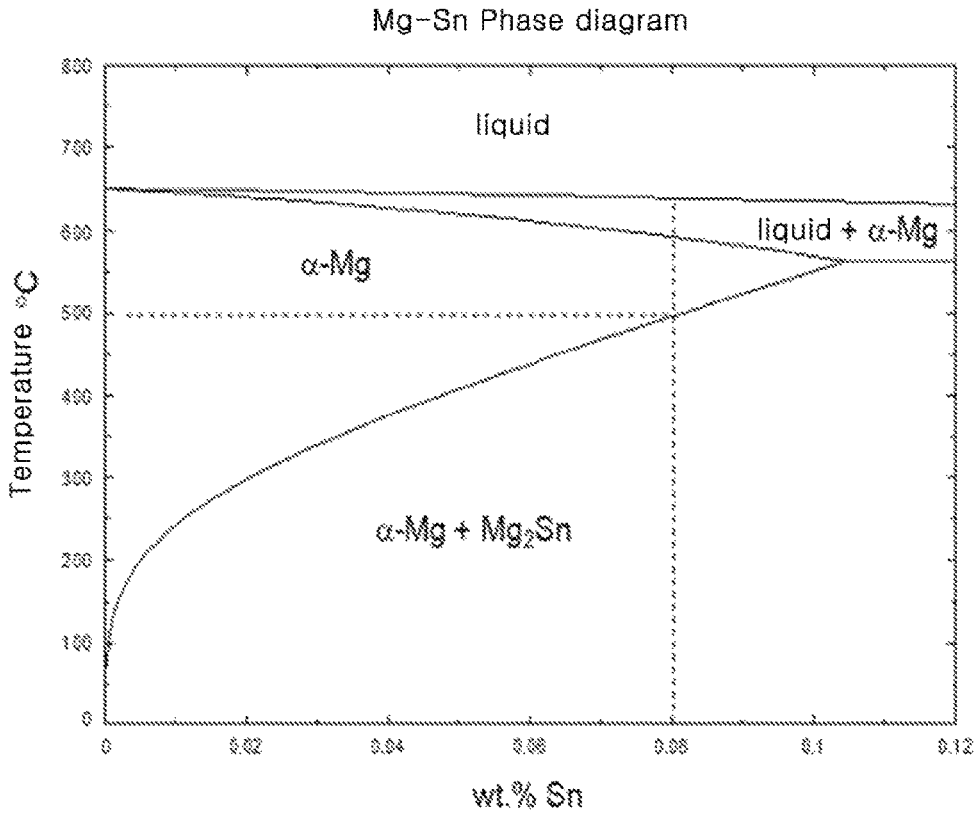
FIG. 3 is a phase diagram of a binary Mg—Sn alloy, which shows a temperature range for which a homogenization annealing process can be applied when Sn is added by 8% by weight.

Reference will now be made in detail to exemplary embodiments of a magnesium (Mg) alloy and a method of manufacturing the same according to the present invention. However, it is to be understood that the following embodiments are illustrative but do not limited the invention.

Manufacture of Magnesium

The inventors of the invention manufactured Mg alloys having a variety of compositions in order to solve the foregoing problems with the related art and realize the object of the invention. The method of manufacturing an Mg alloy according to an exemplary embodiment of the invention is as follows.

First, raw materials that include Mg (99.9%), Sn (99.99%), Al (99.9%), Zn (99.99%), Ca (99.9%), Y (99.9%), and Er (99.9%) were prepared together with an Mg-2.4 wt % Mn master alloy, and they were then melted. Then, Mg alloy cast materials having the alloy compositions described in examples 1 to 12 and comparative examples 1 to 10 in Table 1 below were produced using a gravity casting method. Specifically, the temperature of a molten alloy was increased up to a temperature between 850° C. and 900° C., so that Ca, Y, and Er, which have relatively high melting points, were completely melted, in order to produce an alloy by directly inputting the elements into the molten alloy. After that, the molten alloy was gradually cooled down to a casting temperature, and then the Mg alloy cast materials were produced by casting the molten alloy.

TABLE 1

| | Mg | Al | Zn | Sn | Mn | Ca | Y | RE |
|---|---|---|---|---|---|---|---|---|
| Comp. Ex. 1 | Bal. | | | 8 | | | | |
| Comp. Ex. 2 | Bal. | | | 8 | | 1 | | |
| Comp. Ex. 3 | Bal. | | | 8 | | 0.3 | | 1Gd |
| Comp. Ex. 4 | Bal. | | | 8 | | 0.3 | | 1Sm |
| Comp. Ex. 5 | Bal. | 1 | 1 | 8 | | | | |
| Comp. Ex. 6 | Bal. | 1 | 1 | 8 | | 0.3 | | |
| Comp. Ex. 7 | Bal. | 1 | 1 | 8 | | 0.3 | | 1Gd |
| Comp. Ex. 8 | Bal. | 1 | 1 | 8 | | 0.3 | | 1Sm |
| Comp. Ex. 9 | Bal. | 4 | 1 | 5 | | | | |
| Comp. Ex. 10 | Bal. | 6 | 1 | 4 | 0.22 | | | |
| Ex. 1 | Bal. | | | 8 | | 0.3 | 1.0 | |
| Ex. 2 | Bal. | | | 8 | | 0.3 | | 1Er |
| Ex. 3 | Bal. | 1 | | 8 | | 0.3 | 1.0 | |
| Ex. 4 | Bal. | | 1 | 8 | | 0.3 | 1.0 | |
| Ex. 5 | Bal. | 1 | 1 | 8 | | 0.3 | 1.0 | |
| Ex. 6 | Bal. | 1 | 1 | 8 | | 0.3 | 0.3 | |
| Ex. 7 | Bal. | 1 | 1 | 8 | | 0.3 | | 1Er |
| Ex. 8 | Bal. | 4 | 1 | 5 | | 0.3 | 1.0 | |
| Ex. 9 | Bal. | 4 | 1 | 5 | | 0.3 | 0.6 | |
| Ex. 10 | Bal. | 4 | 1 | 5 | | 0.3 | 0.3 | |
| Ex. 11 | Bal. | 4 | 1 | 5 | | 0.15 | 0.2 | |
| Ex. 12 | Bal. | 6 | 1 | 4 | 0.22 | 0.6 | 0.3 | |

Alternatively, according to an exemplary embodiment of the invention, it is possible to manufacture an Mg alloy by a variety of methods in addition to the method in which casting is performed after a molten alloy is formed by melting raw materials including Mg, Sn, Al, Zn, Ca, Y, and Er. In an example, it is possible to produce an Mg alloy cast material by preparing a master alloy ingot of which the contents of Ca and Y or Er are higher than final target values, separately forming a molten Mg alloy using raw materials of Mg, Sn, Al and Zn or alloys thereof, and then inputting the master alloy ingot into the molten Mg alloy. This method is particularly advantageous in that the master alloy ingot can be input at a temperature that is lower than the temperature at which the raw materials of Ca and Y or Er are directly input into the molten Mg alloy, since the melting point of the master alloy ingot is lower than those of the raw materials of Ca and Y or Er. In addition, the production of an Mg alloy according to the invention can be realized by a variety of methods, and all methods of producing an Mg alloy that are well-known in the art to which the invention belongs are included as part of the invention.

In this embodiment, a graphite crucible was used for induction melting, and a mixture gas of $SF_6$ and $CO_2$ was applied on the upper portion of the molten alloy, so that the molten alloy did not come into contact with the air, in order to prevent the molten alloy from being oxidized before the alloying process was finished. In addition, after the melting was completed, mold casting was performed using a steel mold. A cylindrical billet having a diameter of 80 mm and a length of 150 mm was manufactured for an extrusion test. Although the Mg alloy was cast by a mold casting method in this embodiment, a variety of casting methods, such as sand casting, gravity casting, squeeze casting, continuous casting, strip casting, die casting, precision casting, spray casting, semi-solid casting, and the like, may also be used. The casting method of the Mg alloy of the present invention is not necessarily limited to a specific casting method.

Extrusion of Mg Alloy

Afterwards, the billets that were prepared above were subjected to homogenization annealing at 480° C. to 500° C. for 6 hours. Immediately after the homogenization annealing was performed, the billets were cooled in water at room temperature in order to suppress a coarse precipitation phase from being created during the cooling stage of the billets. In sequence, in comparative examples 1 to 10 and examples 1 to 12 in Table 1, rod-shaped extruded materials having smooth surfaces, a final diameter of which was 16 mm, were manufactured under conditions including a ram speed of 1.3 mm/s, an extrusion ratio of 25, and an extrusion temperature of 250° C. The extrusion test was performed using an indirect extruder having a maximum extrusion pressure of 500 tons.

Although the extrusion was performed after homogenization annealing in this embodiment, the materials may be manufactured by a variety of working methods, such as rolling, forging and drawing, without being necessarily limited to a specific working method.

Further, although the materials were manufactured by an indirect extrusion method in the embodiment, the materials may be manufactured by other extrusion methods, such as direct extrusion, hydro static extrusion, impact extrusion or the like, without being necessarily limited to a specific extrusion method.

Further, although the materials were manufactured into rod-shaped extruded materials in this embodiment, the materials may be manufactured into a various kind of materials, such as pipes, angled materials, sheet-like materials, profile-type materials, without being necessarily limited to a specific shaped-material.

Moreover, although extrusion conditions included the extrusion ratio of 25 and the ram speed of 1.3 mm/s in this embodiment, the extrusion conditions may not necessarily be limited to such specific extrusion ratio and ram speed.

Measurement of Ignition Temperature

In order to measure the ignition temperature of the Mg alloys, chips having a predetermined size were produced by machining the outer portion of the cylindrical billets, which were manufactured above, in conditions including a depth of 0.5 mm, a pitch of 0.1 mm, and a constant speed of 350 rpm. 0.1 g chips that were prepared by the foregoing method were heated by loading them at a constant speed into a heating furnace, which was maintained at 1000° C. The temperatures at which a sudden rise in temperature begins during this process were determined as ignition temperatures, and the results are presented in Table 2.

TABLE 2

| | Ignition Temp. (Air) [° C.] | Increment in Ignition Temp. [° C.] |
|---|---|---|
| Comp. Ex. 1 | 281 | |
| Comp. Ex. 2 | 359 | 78 (compared to Comp. Ex. 1) |
| Comp. Ex. 3 | 427 | 146 (compared to Comp. Ex. 1) |
| Comp. Ex. 4 | 399 | 118 (compared to Comp. Ex. 1) |
| Comp. Ex. 5 | 373 | |
| Comp. Ex. 6 | 460 | 87 (compared to Comp. Ex. 5) |
| Comp. Ex. 7 | 426 | 53 (compared to Comp. Ex. 5) |
| Comp. Ex. 8 | 458 | 85 (compared to Comp. Ex. 5) |
| Comp. Ex. 9 | 461 | |
| Comp. Ex. 10 | 468 | |
| Ex. 1 | 520 | 239 (compared to Comp. Ex. 1) |
| Ex. 2 | 542 | 261 (compared to Comp. Ex. 1) |
| Ex. 3 | 525 | 244 (compared to Comp. Ex. 1) |
| Ex. 4 | 537 | 256 (compared to Comp. Ex. 1) |
| Ex. 5 | 573 | 200 (compared to Comp. Ex. 5) |
| Ex. 6 | 560 | 187 (compared to Comp. Ex. 5) |
| Ex. 7 | 531 | 158 (compared to Comp. Ex. 1) |
| Ex. 8 | 654 | 183 (compared to Comp. Ex. 9) |
| Ex. 9 | 641 | 170 (compared to Comp. Ex. 9) |
| Ex. 10 | 639 | 168 (compared to Comp. Ex. 9) |
| Ex. 11 | 625 | 164 (compared to Comp. Ex. 9) |
| Ex. 12 | 719 | 251 (compared to Comp. Ex. 10) |

In Table 2, the ignition temperature of Mg-8 wt % Sn alloy according to comparative example 1 is 281° C., which is much lower than the ignition temperature, i.e. ignition resistance of pure magnesium (about 450° C.). Generally, the ignition resistance depends upon kinds and structures of oxide layers formed on the surface of a material. It is estimated that the very poor ignition resistance of the Mg—Sn alloy was caused by the fact that the oxide layer which is dominantly formed on the surface of the Mg—Sn alloy is an Sn-containing oxide layer, rather than MgO, and the Sn-containing oxide layer has a porous structure that is thermally unstable compared to the structure of MgO, so that the porous structure cannot block reaction with external oxygen. On the contrary, it can be seen that comparative examples 5 and 9 in which Al and Zn were added to Mg-8 wt % Sn alloy exhibited higher ignition temperature than comparative example 1, and particularly an increment in ignition temperature was high as the content of Al increased. However, nevertheless the ignition temperatures of comparative examples 5 and 9 were not greater than 460° C., which is still low.

Ignition temperature of comparative example 2, in which 1% by weight of Ca was added to the composition of comparative example 1, was 359° C. that is higher about 80° C. than the ignition temperature prior to the addition of Ca. According to existing studies on an increase in ignition temperature with the addition of Ca, when 1% by weight of Ca was added to AZ31 alloy, the ignition temperature increased by about 220° C. from 490° C. to 708° C. In contrast, it can be appreciated that an increment in ignition temperature of comparative example 2, in which the same content of Ca was added to Mg-8Sn alloy in Table 2, was very low. In addition, similar to comparative example 6, in which 0.3% by weight of Ca was added to Mg-8Sn-1Al-1Zn alloy according to comparative example 5, similar to comparative example 2, an increase in ignition temperature in response to the addition of Ca was about 90° C., which is not significant. Like this, it can be appreciated that the ignition temperature of Mg—Sn alloy was still low even when Ca that is a most effective element known to improve ignition resistance of an Mg alloy was added.

On the contrary, comparing example 1 and examples 3 to 6, in which a small amount of Ca and Y was added in combination, with comparative example 2 and comparative example 6, respectively, it can be seen that the ignition temperature of example 1, in which 0.3% by weight of Ca was added in combination with 1% by weight of Y, increased considerably compared to comparative example 2 in which 1% by weight of Ca was added. In addition, an increment in ignition temperature of the alloy containing 0.3% by weight of Ca and 1% by weight of Y was about 240° C., whereas an increment in ignition temperature of the alloy containing 1% by weight of Ca alone was merely about 80° C. Further, the ignition temperature of example 1 was 520° C. that is higher than an available homogenization annealing temperature of 500° C. As can be seen from examples 3 to 5 in Table 2, it can be appreciated that an effect of combined addition of Ca and Y further increased when Al and Zn were selectively or simultaneously added to the alloy of example 1. In addition, the ignition temperature of example 5 was 573° C. that is higher by 200° C. than that of comparative example 5, in which Ca and Y were not added, due to combined addition of Ca and Y. Example 6 is an alloy in which the content of Y was reduced, by weight, to 0.3% from 1% of example 5. The ignition temperature of example 6 was 560° C. that is lower by only 13 degrees than that of example 5 even though the content of Y was decreased considerably, so that it is expected that the content of Y that is a costly element can be reduced.

Variations in ignition temperatures of materials, in which a rare earth metal element, rather than Y, was added in combination with Ca, were measured. As can be seen from examples 3 and 4, ignition temperatures of Sm and Gd among rare earth elements were 427° C. and 399° C., respectively, so that the effect of adding Sm and Gd was not significant compared to the effect of adding Y. Similarly, as compared between comparative example 6 and comparative examples 7 and 8, the ignition temperatures of the materials, in which Sm or Gd was added, decreased compared to comparative example 6 in which Ca was added alone. Thus, it is determined that Sm and Gd are elements that are not suitable to be added to Mg—Sn alloy in combination with Ca. In contrast, as can be seen from examples 2 and 7 in Table 2, an increment in ignition temperature of the alloy, in which both Ca and Er were added, was higher than that of the alloy in which Ca was added alone. Therefore, according to experimental results of the present invention, it can be appreciated that ignition temperature of Mg-8Sn alloy was considerably increased to 520° C. or more in response to the addition of Ca and Y, or Ca and Er.

Although in the case of comparative example 9, in which the content of Sn was reduced to 5% by weight and the content of Al was increased to 4% by weight, the ignition temperature was 461° C. so that ignition resistance was high compared to other Mg-8Sn alloys, due to an increase in the content of Al, the temperature does not still reach an available homogenization annealing temperature that is high. It can be appreciated from examples 8 to 10 in Table 2, in which Ca and Y were added to the alloy of comparative example 9, that the ignition temperature was increased to a melting point or more of the alloy. Although the ignition temperature tends to gradually decrease in response to a decrease in the content of Y, like the comparison between example 5 and example 6, when the contents of Ca and Y were respectively reduced, by weight, from 0.3% and 1% to 0.15% and 0.2%, a decrement in the ignition temperature was merely about 30° C. and the ignition temperature was 625° C. that is still greater than a melting point of the alloy, exhibiting excellent ignition resistance.

Further, it can be seen that, while the ignition temperature of comparative example 10 in Table 2, in which 4% by weight of Sn was added to the alloy (AZ61 alloy) which contains, by weight, 6% Al, 1% Zn, and 0.22% Mn, was 468° C., the ignition temperature of example 12, in which both 0.6% by weight of Ca and 0.3% by weight of Y were added, increased to 719° C.

Evaluation of Mechanical Properties

The extruded materials, which were manufactured by the above-described method, were prepared into sub-size samples according to the ASTM-E-8M standard, in which the length of a gauge is 25 mm, and a tensile test was carried out at room temperature under a strain of $1\times10^{-3}s^{-1}$ using a common tensile tester.

Figure 4:
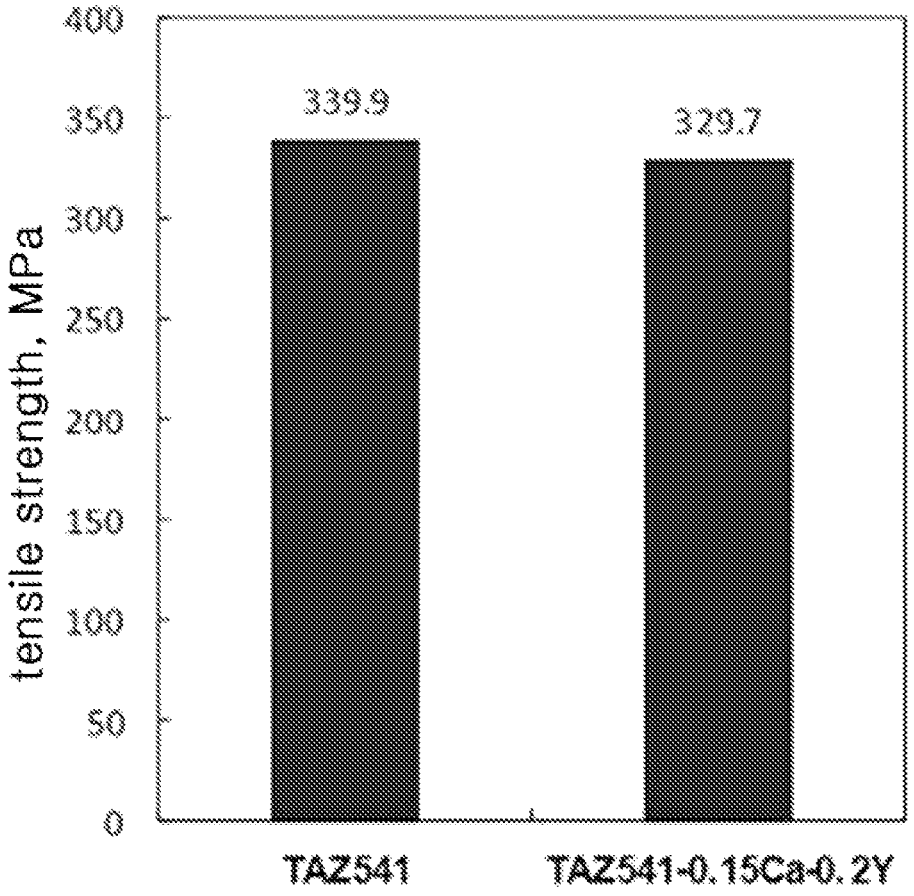
FIG. 4 is a graph showing the tensile strength of TAZ541 alloy and extruded TAZ541-0.15Ca-0.2Y alloy, which are a comparative example and an example according to a preferred embodiment of the present invention.
Figure 5:
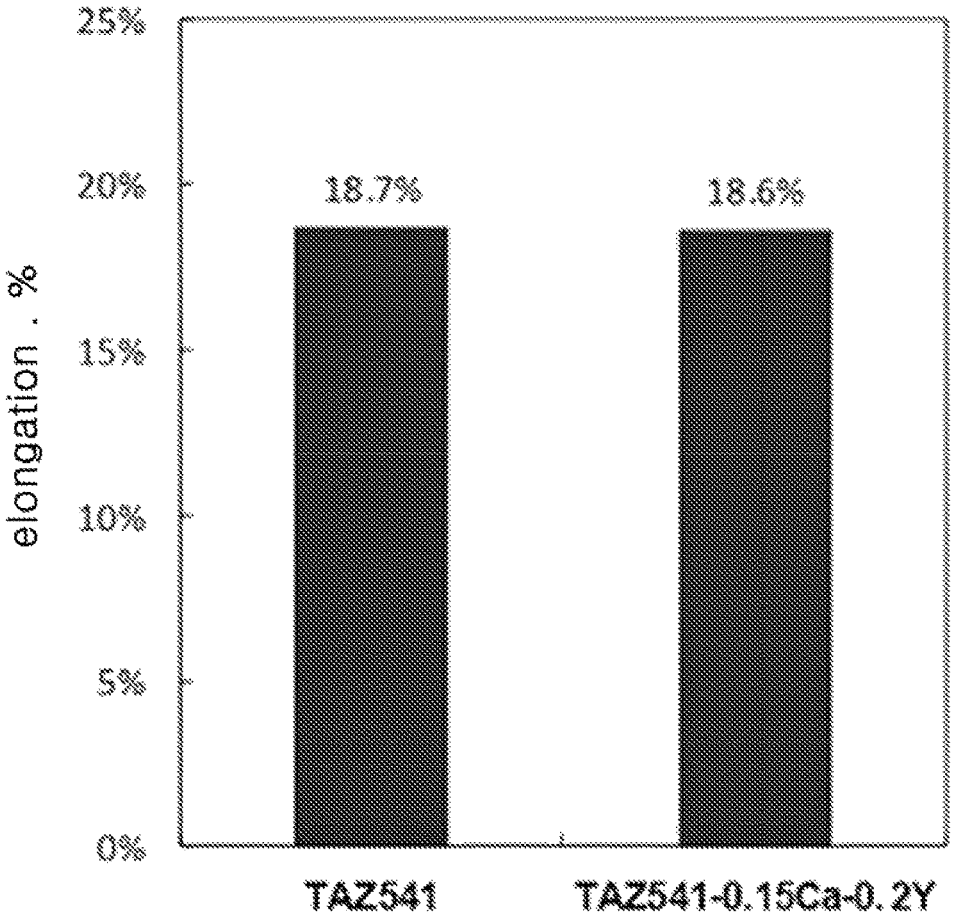
FIG. 5 is a graph showing the elongation of TAZ541 alloy and extruded TAZ541-0.15Ca-0.2Y alloy, which are a comparative example and an example according to a preferred embodiment of the present invention.
Figure 6:
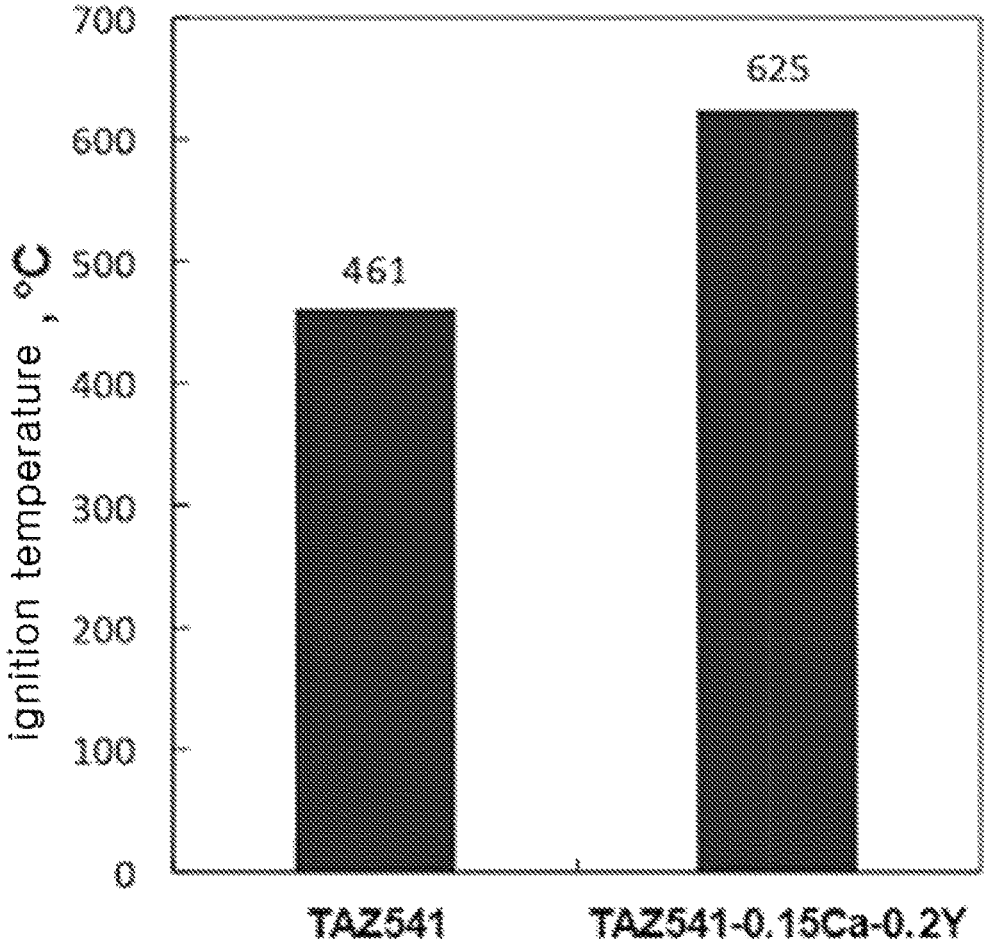
FIG. 6 is a graph showing the ignition temperature of TAZ541 alloy and extruded TAZ541-0.15Ca-0.2Y alloy, which are a comparative example and an example according to a preferred embodiment of the present invention.

FIGS. 4 to 6 show tensile properties of comparative examples 9 and example 11 that were compared. It is appreciated that, when a small amount of Ca and Y was added, as shown in FIG. 6, the ignition temperature of example 11 was increased by 164° C. from that of comparative example 9, whereas, as shown in FIGS. 4 and 5, the tensile strength and elongation did not change.

The Mg alloy and the method of manufacturing the same according to exemplary embodiments of the present invention have been described above in detail with reference to the accompanying drawings. However, it will be apparent to a person having ordinary skilled in the art to which the present invention belongs that the foregoing embodiments are merely examples of the invention and various modifications and variations are possible. Therefore, it should be understood that the scope of the invention shall be defined only by the appended claims.

The invention claimed is:

1. A wrought magnesium (Mg) alloy having a composition comprising: by weight, 4% to 10% of Sn; 0.05% to 0.6% of Ca; 0.1% to 2% of at least one element selected from the group including Y and Er; the balance of Mg; and the other unavoidable impurities, wherein the Mg alloy includes an $Mg_2Sn$ phase.

2. The wrought magnesium alloy of claim 1, wherein the content of Sn ranges, by weight, from 4.5% to 8.5%.

3. The wrought magnesium alloy of claim 1, wherein the content of the at least one element selected from Y and Er ranges, by weight, from 0.1% to 1%.

4. The wrought magnesium alloy claim 1, wherein the composition of the Mg alloy further comprises, by weight, 0.5% to 6.5% of Al.

5. The wrought magnesium alloy of claim 1, wherein the composition of the Mg alloy further comprises, by weight, 0.1% to 3% of Zn.

6. The wrought magnesium alloy of claim 1, wherein the composition of the Mg alloy further comprises, by weight, greater than 0% but not greater than 0.5% of Mn.

7. The wrought magnesium alloy of claim 1, wherein the Mg alloy has an ignition temperature of 500° C. or more.

* * * * *